US006279667B1

(12) United States Patent
Culver

(10) Patent No.: US 6,279,667 B1
(45) Date of Patent: Aug. 28, 2001

(54) ROTATING PUSH ROD BORING SYSTEM

(76) Inventor: R. Barry Culver, P.O. Box 1234, Claresholm, Alberta, TOL OTC (CA)

( * ) Notice: Subject to any disclaimer, the term of this patent is extended or adjusted under 35 U.S.C. 154(b) by 0 days.

(21) Appl. No.: 09/597,249

(22) Filed: Jun. 20, 2000

Related U.S. Application Data

(60) Provisional application No. 60/139,800, filed on Jun. 21, 1999.

(51) Int. Cl.[7] ..... E21B 7/26
(52) U.S. Cl. ..... 175/19
(58) Field of Search ..... 175/19, 20, 61, 175/62, 21, 73, 74, 75; 405/142, 146, 154, 184

(56) References Cited

U.S. PATENT DOCUMENTS

| | | |
|---|---|---|
| 4,306,626 | 12/1981 | Duke et al. . |
| 4,347,692 | 9/1982 | Culver . |
| 4,455,107 | 6/1984 | Schosek . |
| 4,492,274 | 1/1985 | Schosek . |
| 4,542,796 | 9/1985 | Delbarre . |
| 4,596,292 | 6/1986 | Crover . |
| 4,694,913 | 9/1987 | McDonald et al. . |
| 4,858,704 | 8/1989 | McDonald et al. . |
| 4,936,709 | 6/1990 | Kimura . |
| 4,945,999 | 8/1990 | Malzahn . |
| 5,070,948 | 12/1991 | Malzahn et al. . |

*Primary Examiner*—Robert E. Pezzuto
(74) *Attorney, Agent, or Firm*—Sean W. Goodwin

(57) ABSTRACT

A push rod rotator and push rod boring rig uses a reciprocating carriage to push a drill string of push rods into the ground and pull the drill string back out usually with an expander and pipe or utility lines. A push rod rotator is connected to a swivel supported on the non-rotating carriage. The rotator is a two-part assembly, one part is a non-rotating conduit, having two or more helical slots and the other part has a pin which follows the slots for inducing relative rotation. Slips grip the push rods and are reversible to enable push and pull operations. Preferably the slips trail the carriage and the rotator leads the swivel. The rotator is adapted to a boring rig having a frame, and hydraulic cylinders for reciprocating the carriage relative to the rig. The double-acting cylinders are mounted in pairs with the powerful extension stroke oriented to pull back the drill string and push rods and the weaker retraction stroke to push rods.

11 Claims, 13 Drawing Sheets

26A
26D
26B
26
26C (TYP.)
102B
103 (TYP.)
24
24A
102
102C (TYP.)
31A (TYP.)
24B (TYP.)
31
31B (TYP.)
30
24
28
103 (TYP.)
22
32
21
21A
34
34A
24
27
22
27
27B (TYP.)
23A
22
24
27
23B (TYP.)
23A
30
23
23D (TYP.)
28A (TYP.)
23C (TYP.)
25A
23
27
25B
27B (TYP.)
25
27
27A (TYP.)
20
27

301
302
301A
(TYP.)
302A
303
303
302A
304A
304
304
301
304A
302
303

301
304
305A
305
306
306A
305A
305
301
302
305A
306
306A
305
305A
305
304
307A
312
309
307A (TYPICAL)
308 (TYPICAL)
307
312
307
311 (TYPICAL)
301
309
302
300
305

Fig. 6a
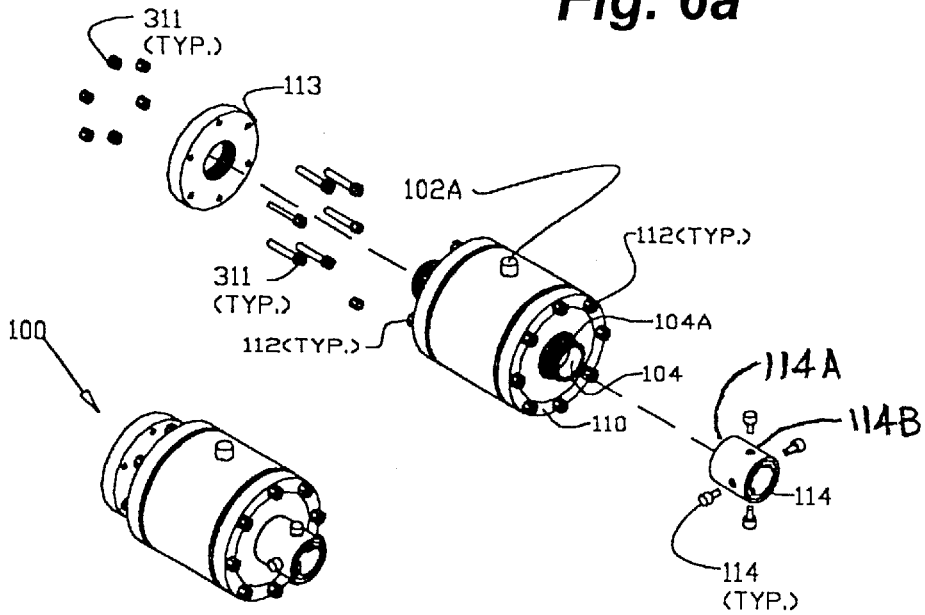
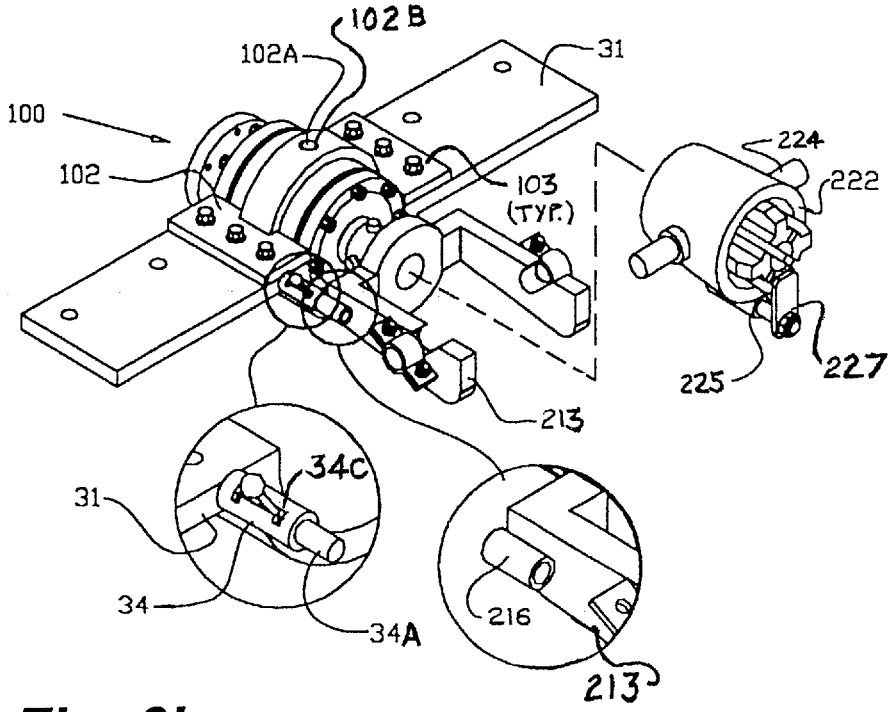
Fig. 6b

ROTATING PUSH ROD BORING SYSTEM

This application is a continuation-in part of Provisional Application 60/139,800, filed Jun. 21, 1999.

FIELD OF THE INVENTION

This invention relates to an earth-boring machine such as a rotating push rod boring system operable to form generally horizontal passageways for conduits, cable, etc. beneath an established earth surface without disturbing the top surface. More particularly, the invention relates to an improved hydraulic rotating push rod boring system having alternating or simultaneous axial and rotation movement of a push rod.

BACKGROUND OF THE INVENTION

The benefits of trench-less digging for installing underground utility lines are well known. A number of different types of devices are available for the purpose of installing underground utility services without cutting an open trench or otherwise disturbing the earths surface or items rest thereupon. These devices include percussion boring tools, rotary boring tools or earth augers, and push rod boring systems. The present invention relates to a rotary push rod boring system.

Each of these different types of underground boring devices has a specific purpose and specific operating characteristics. Their use depends on the type of soil in which the borehole will be formed, the length and diameter of the borehole, conditions at the job site, and a number of other factors.

One type of devices is a push rod boring system which is a relatively simple, compact device for sequentially thrusting an increasing length drill string composed of push rods through the ground from a small subsurface launching pit or surface location to reach a target pit or another surface location. A boring head at the leading end of the drill string forms a small initial borehole. Taking advantage of the greater stability provided by pulling a slender rod, rather than pushing, apparatus is subsequently pulled back with the drill string of push rods. For instance, an enlarged head member or utility lines can be attached to the leading end of the drill string and then be retracted forcibly back through the initial borehole.

Improvements to the above boring devices, and more specifically to push rod boring systems, include the development of tracking and monitoring devices for the progress and orientation of the boring head. Also, there have been various means developed to correct or change the path of the boring head as the tool progresses, for implementing a change in direction, or if the boring head begins to deviate from the desired path because of changing soil conditions, rocks, or other obstructions.

One method of directing the path of the drill string is to use a boring head which has a beveled leading edge which cause the head to deflect. Use of a simple pushing action then results in a continuous curved borehole. However, substantially straight boreholes can be formed by the simultaneous rotational and axial advance of the drill string in a progressing helically spiraling movement to form a substantially straight borehole through the soil.

When a directional change is desired, rotation is discontinued when the boring head is orientated along the new path. As the drill string continues to advance through the soil without rotation, the resultant soil forces on the boring head act to deviate from its straightline course and to move instead along a curved path. As long as the bevel face of the boring head is first maintained in this same orientation, the path of the drill string will follow a continuous curve.

After the steering correction or change is completed, combined axial and rotational movement is continued.

Directional monitoring means include attachment of an electronic transmitter, sonde or similar device to the leading end of the drill string, usually combined with a boring head having a cutting tip or bevel face. Electronic transmitters, sondes or similar devices are used to monitor progress of the boring head, and determine the need for path corrections or changes, and to indicate the orientation of the bevel face.

More specifically, in U.S. Pat. No. 4,306,626 to Duke (Duke '626), a hydraulic push rod boring system is disclosed comprising a basic push rod boring system without directional control. This push rod system incrementally advances push rods into a bore by gripping the rod with a jaw mechanism that is thrust forward by a hydraulic cylinder. This form of mechanism is similar to that used with hand-held caulking guns. At the end of each cylinder stroke, the jaws are released from the rod and the cylinder is retracted for the next pushing increment. Additional push rods are added to the back end of the drill string as needed.

The addition of beveled face boring head would enable Duke's apparatus to form a deviated borehole, however, without the further addition of means for imparting rotary motion to the drill string, Duke cannot directionally control the drilling.

Thus, when a directional-boring head is used with this push rod system, the drill string of push rods must be rotated manually by the crew through the use of pipe wrench by pushing on the jaw handle, a tedious and inefficient method.

An automated rotation system is disclosed in U.S. Pat. No. 4,694,913 to MacDonald et al., discloses a rotary push rod boring system with bevel face boring head, having directional control. In order to achieve rotational motion necessary for directional control, this device uses an independent motor and control assembly, which provides either axial movement or combined axial and rotational movement to the drill string. This device requires however, a complex and expensive control mechanism.

As an improvement to the apparatus of Duke, U.S. Pat. Nos. 4,945,999 to Malzahn (Malzahn '999) and 5,070,948 to Malzahn et al. (Malzhan '948) disclose the addition of directional control and steering capabilities to the basic hydraulic push rod boring system. Malzahn '999 and '948 attach conversion devices to a push rod system so as to provide both axial and rotational movement of the drill string without using independent motors or other power sources, in other words, use the push stroke to effect rotation as well.

The conversion devices of Malzahn '999 and '948 comprise, in a first instance, a rigid link mounted between a fixed point and the jaw of Duke '626. In second instance a conversion device comprises, a cam follower mounted on the jaw and a rigid cam guide extending diagonally across the apparatus, and in a third instance, the jaw is pinned between intermediate cables, the cables ending at a leading fixed point positioned to one side of the jaw and at a rearward fixed point positioned to the other side of the jaw. The result of all of these conversion devices is to cause the jaw to be rotated a total of about 60 degrees.

Actual field use of these hydraulic rotating push rod systems has shown that a number of improvements are needed to increase the effectiveness, and overcome a number of existing known problems.

The plate type gripping assembly of Duke and as disclosed in Malzahn '999 and '948 damages the exterior surface of the push rods during each push stroke. The locking action of the opposing single plane movement of the gripping assembly plates, creates transverse or crosswise marks, scoring, indentations, and can even bend the push rod out of true alignment during high load push and operations. Misalignment of the locking plates on areas of previously damaged push rods adversely affects positive gripping and subsequent advance or retraction of the drill string.

Further, the plate-type apparatus results in slow forward movement, with a large number of strokes required to complete a borehole. Each forward stroke of the hydraulic thrust cylinder pushes the drill string forward only about nine inches and a maximum of 60 degrees of clockwise rotation. Thus a typical four-foot long push rod is pushed its length and rotated only 320 degrees clockwise, through just over five complete (forward and back) strokes of the hydraulic thrust cylinder.

The conversion devices Malzahn '999 and '948 introduce lull periods in the rotation, specifically as the jaw passes through the middle portion of the stroke. At this middle point, the path defined by the links, cables and tracks are substantially tangent to the push rod movement and thus impart very little rotation. In the straight drilling portion of a borehole, the rotational lull coupled with the small overall slow rotation does not create a tight helical spiral, nor one that is particularly straight. In fact, the forward progression of the boring head, and the subsequent borehole, tend to form an asymmetric helical spiral through the soil.

Movement through the distorted helical borehole in either direction may experience areas of binding. As a result, and exacerbated because the drill string is composed of individual push rods threaded together end-to-end, there is an increased likelihood of rod bending, and thread damage to push rod joints.

Tracking and orientation of the bevel face of the boring head is also affected by the slow rotation, lag and uneven rotation of the drill string. During drilling, consistent high and continual rotation of the drill string is required for effective directional control and monitoring of the orientation of boring head.

The conversion devices are exposed and the potential for damage during use is increased. Further, under the repetitive cycling, cables in the conversion devices experience wear and stretch, which require constant monitoring and adjustment.

Additionally, as stated above, following completion of a borehole, the drill string is pulled back with a bore enlarger or lines of some sort. This requires significant pulling force, greater than the force used to push the rods. Applicant notes that the hydraulic cylinders used in the known designs are of the conventional design and thus employ the return stroke of the hydraulic cylinder which, having reduced fluid area due to the piston rod, results in reduced pulling capacity. This is contrary to the need for increased capacity to overcome the substantial increases in resistance encountered during pull-back of drill strings with attached apparatus.

Existing hydraulic push rod systems employ a single coaxial hydraulic cylinder. No provisions are known for quickly and simply increasing or decreasing the capacity of hydraulic push rod boring systems with the coupling or removal of additional hydraulic cylinders as needed.

The difficulties and problems suggested in the preceding are not intended to be exhaustive, but rather are among many which may tend to reduce the effectiveness of these systems. Other noteworthy problems may also exist; however, those presented above demonstrate further improvements are needed to known hydraulic rotating push rod systems.

SUMMARY OF THE INVENTION

The present invention utilizes a unique arrangement of apparatus for improving the speed of forming a borehole, virtually eliminating gripping damage to push rods, increasing pull-back forces and producing a more linear borehole.

The novel apparatus and method of use achieves these advantages by increasing the stroke length and providing a large incremental rotation of the drill string each stroke. To accomplish these significant steps, a carriage was provided for handling the push rods and the hydraulic cylinders or other actuators, which drive the carriage, are located straddling the push rods as opposed to being concentric with the push rods. A push rod rotator is arranged concentrically with the push rods and is supported by the carriage for reciprocating push rod driving action. The carriage is non-rotating and thus the rotator is supported thereon through a swivel. The rotator is a two-part assembly, one part is a non-rotation conduit having two or more helical slots and the other part has a pin which follows the slots for inducing relative rotation. The prior art double plate gripping means has been replaced with secure and noninjurious means such as slips. To enable push and pull operations, the slips are reversible. Certain advantages are provided by positioning the slips located trailing the carriage. The tubular object being held by the slips is typically concentric and installed through the axis. Accordingly, to reverse the slip, it is necessary to axially remove the tubular object, in this case, the push rods. Conveniently, so as to avoid the need for mid-drill string decoupling in the rig, the slip is placed at the rear end, where the push rods are added sequentially during operation. This positioning also is easy to access during operation and doesn't interfere with the rotator.

Accordingly, in one broad aspect of the invention a rotator for a push rod boring rig is provided for installation on a reciprocating, non-rotating carriage comprising: a swivel supported by the carriage having a rotating sleeve through which the rods pass, a gripping device such as slips being positioned rearward of the swivel and supported axially and rotationally from the sleeve for moving the push rods unidirectionally as the carriage reciprocates; a torsional member located forwards of the swivel and which is supported by and rotatable with the sleeve through which the push rods pass and having two or more pins extending perpendicularly therefrom; a tubular conduit located and extending concentrically about the torsion member and having two or more helical slots which correspond to and guide the torsional member's pins; so that when the slotted conduit is restrained, and the carriage is reciprocated, the torsional member, sleeve, slips and push rods are urged to rotate in order for the member's pins to follow the slots.

Preferably the rotator is applied to a push rod rig which further includes a frame for supporting the reciprocating carriage and hydraulic cylinders for driving the carriage. The rig is more versatile if the slips are reversible so as to alternately enable both pushing and pulling operation. More preferably, the hydraulic cylinders are arrange so that their greater force extension stroke operates the more intensive pulling operation.

BRIEF DESCRIPTION OF THE DRAWINGS

FIG. 6A is a perspective view of the assembled swivel assembly with the attached rotator connection flange and the attached slip connector sleeve;

FIG. 6B is a perspective view of the complete swivel assembly with an attached partial exploded perspective view of the reversible slip assembly showing detail of the swivel-slip interconnect referred to in FIGS. 3A,4, and 4A.

DESCRIPTION OF THE PREFERRED EMBODIMENT

In Situ Description

Figure 1:
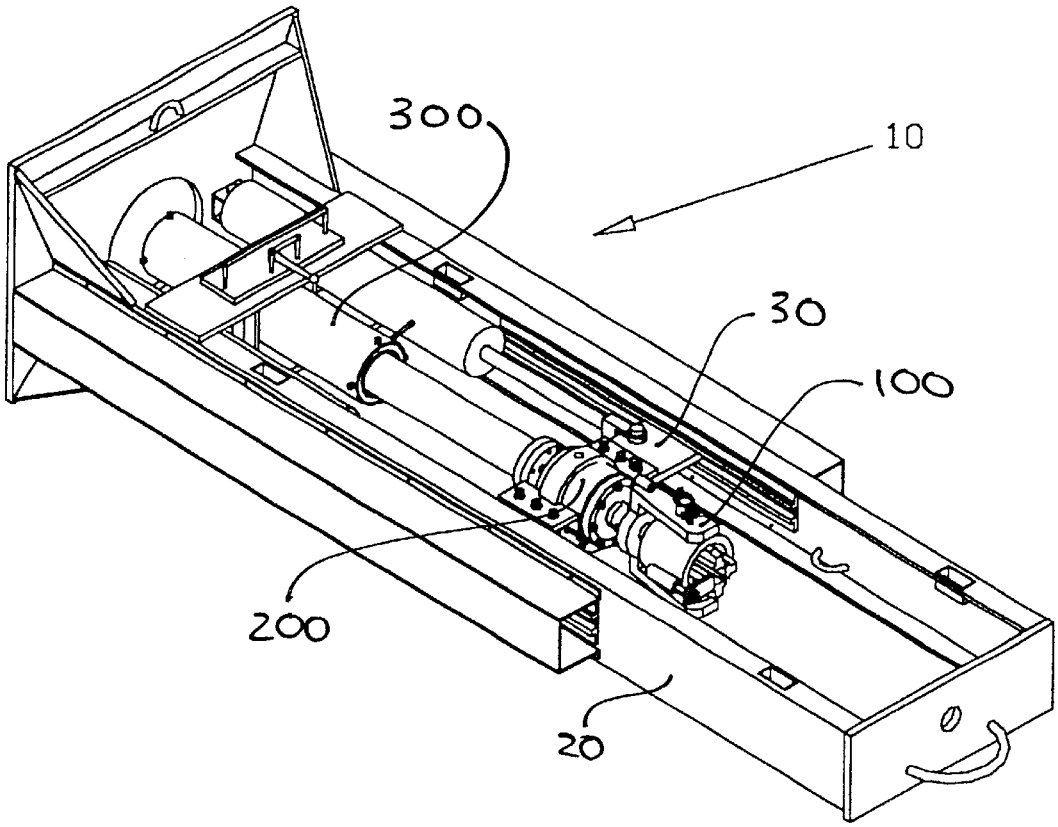
FIG. 1 is a perspective view of the rotating push rod boring rig according to a preferred form of the invention.
Figure 1A:
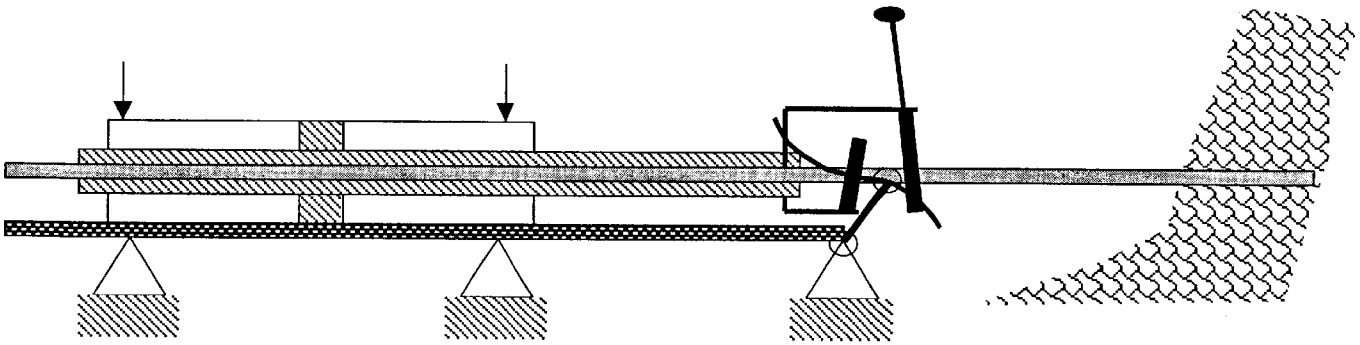
Fig. 1a PRIOR ART
FIG. 1A is a schematic view of the gripping plate prior art apparatus.
Figure 1B:
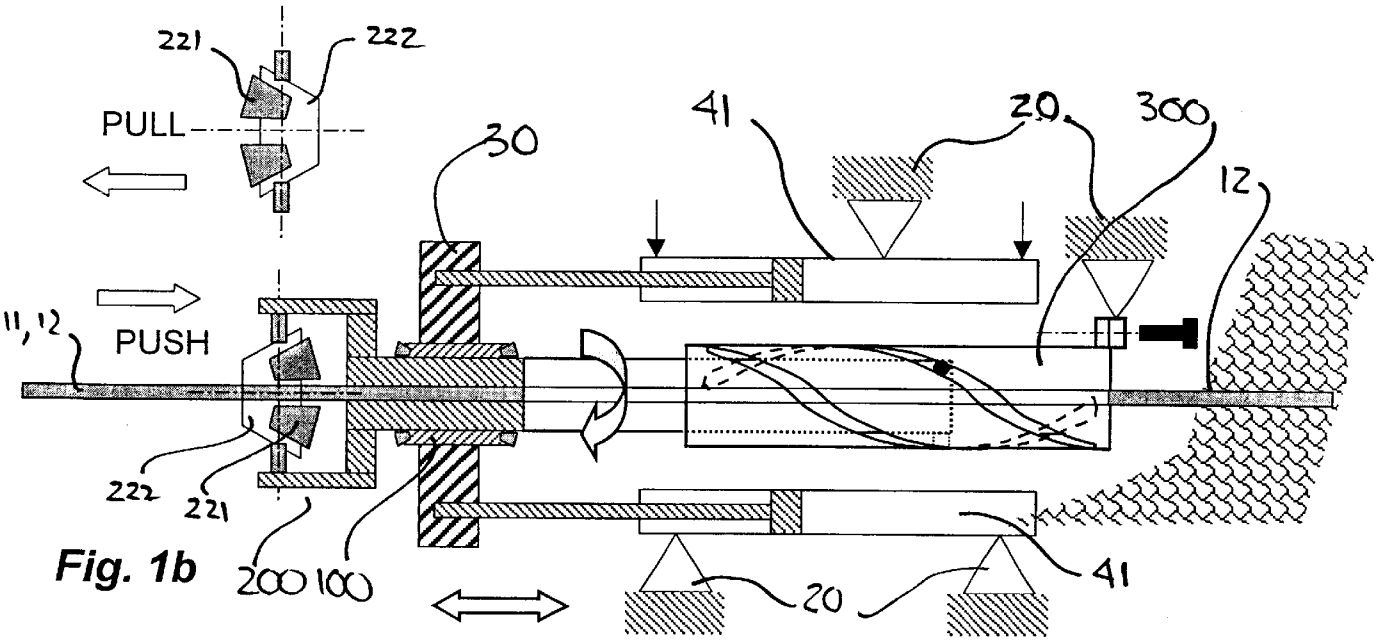
FIG. 1B is a schematic view of the slips, swivel and rotator of the present invention according to FIG. 1.
Figure 2:
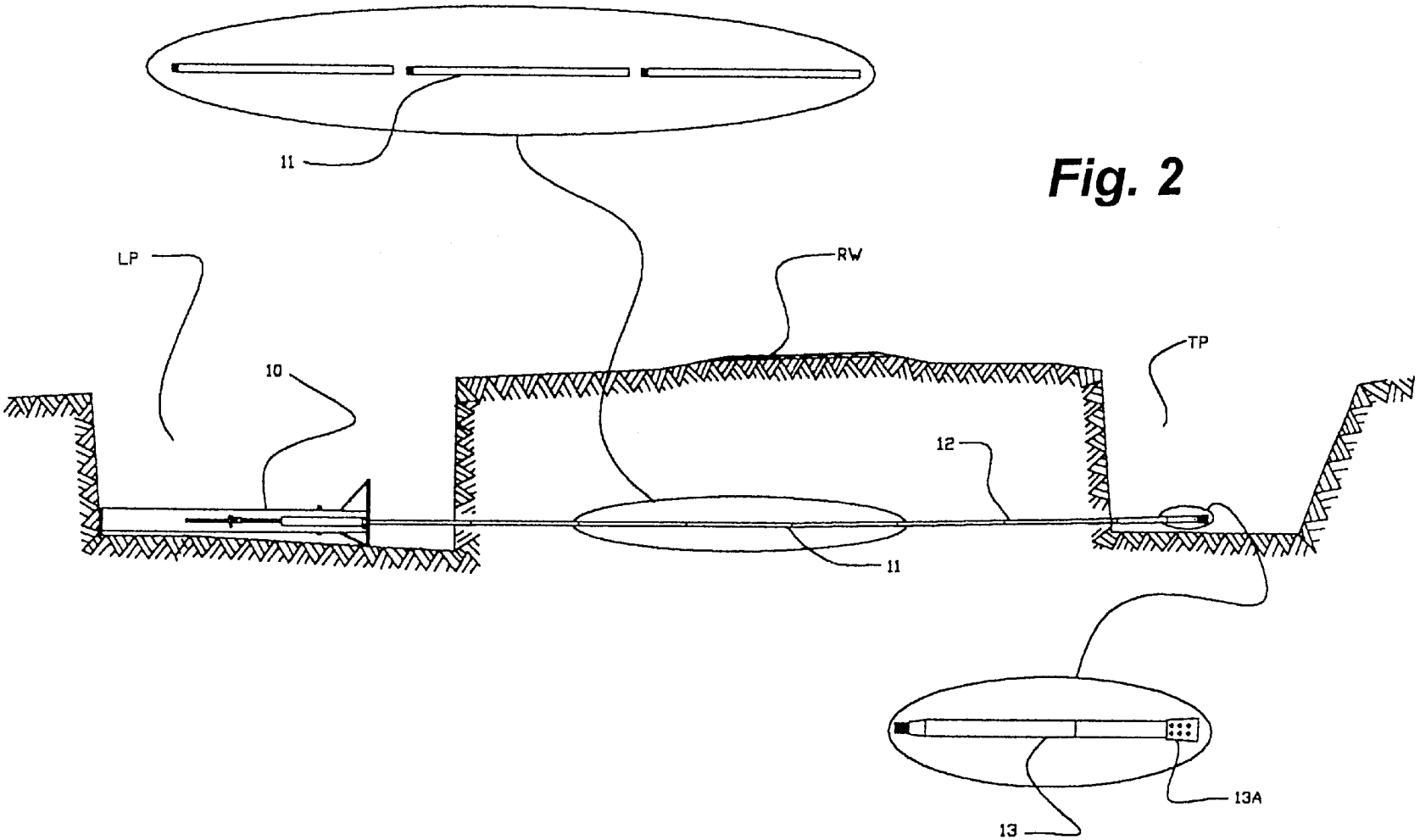
FIG. 2 is a schematic drawing, partially in section, of the rotating push rod boring system according to the present invention.

Having reference to FIGS. 1, 1A, 1B and 2, a rotary push rod boring rig 10 is illustrated. In FIG. 2, the rig 10 is shown positioned for pushing operation, braced against the back wall of a launching pit LP illustrating a plurality of push rods 11 forming a drill string 12 extending from the launching pit LP to a target pit TP. While the rotary push rod boring rig 10 is primarily discussed herein as being operated between pits LP, TP, it may also be arranged directly on the surface and braced from a truck or the like so that the push rods enter the earth at an angle to the surface. The drill string 12 can be directed to the target pit TP or towards a surface target.

The rotary boring rig 10 is positioned to drill a borehole under a surface obstacle, such as a roadway RW, by rotatably pushing the drill string 12 through the earth. Successive push rods 11 are connected together as a drill string 12 and pushed under the roadway RW, forming a borehole of sufficient length so as to reach the target pit TP or other proposed target. During pushing operation, the drill string 12 extends out of one side of the rig 10 (deemed to be the front) and correspondingly, the opposing end or rear end of the rig bears against the pit wall so as to absorb reaction forces. During pulling operation, not shown, the rig 10 is repositioned and is braced at its front end against the other side of the pit LP to absorb pulling forces.

The leading end of drill string 12 includes a boring head 13 with bevel face 13*a*. The boring head 13 may include an electronic transmitter, sonde or similar device for tracking its position and orientation.

After the borehole is completed, the drill string 12 is pulled out of the borehole. If it is necessary to enlarge the diameter of the borehole, an enlarged head may be attached and pulled back through borehole with the drill string 12, usually accompanied by pipe or other apparatus to be placed in the enlarged borehole. Often utility lines are attached to the drill string 12 and are pulled back through borehole.

Overall Components

As opposed to the limited rotational capability of the prior art apparatus of FIG. 1A, the present invention is capable of much greater and more consistent rotation of push rods 11.

Figure 3A:
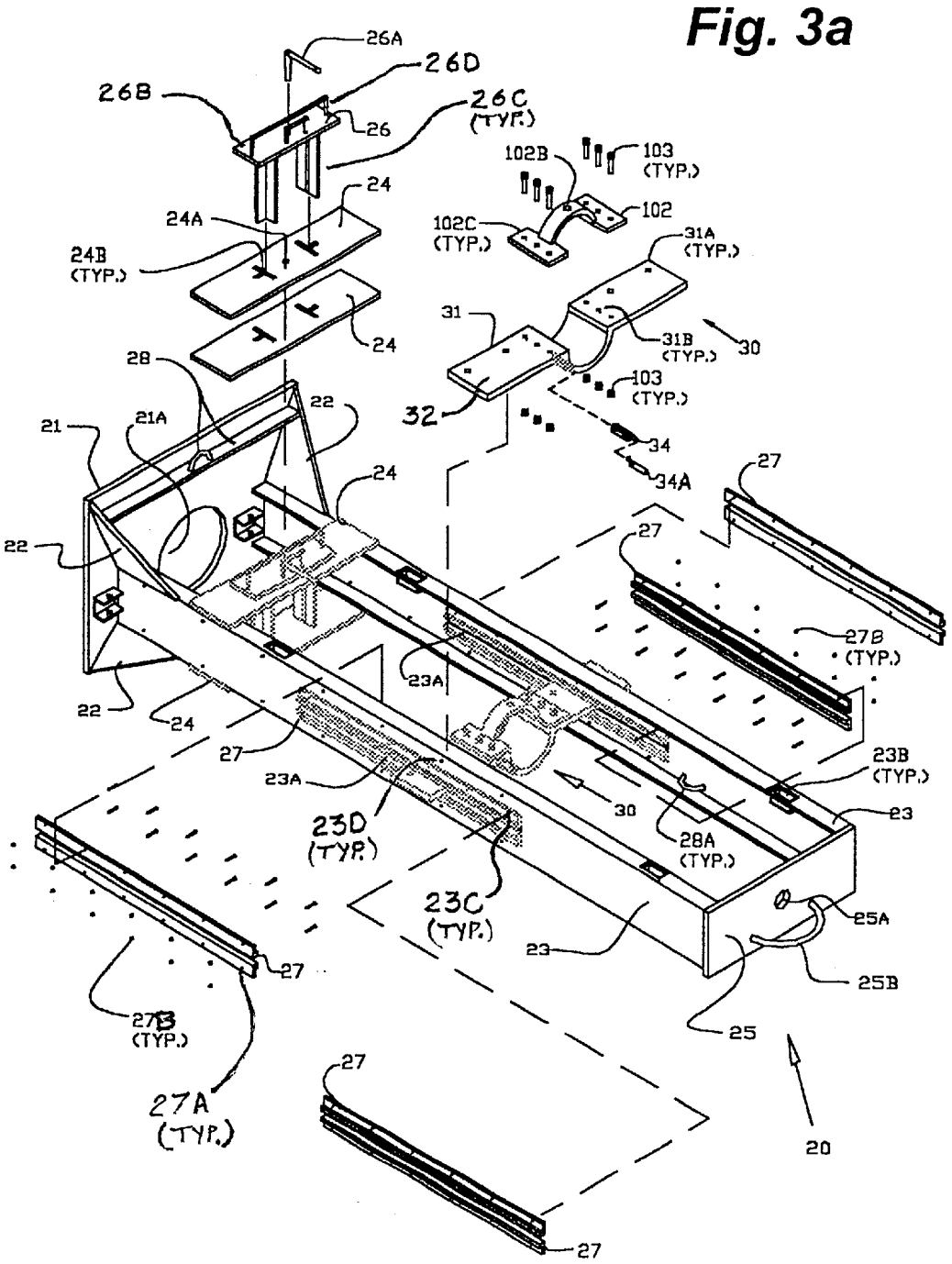
FIG. 3A is a partial exploded perspective view of the present invention, showing the support frame assembly, and the sliding carriage assembly.
Figure 3B:
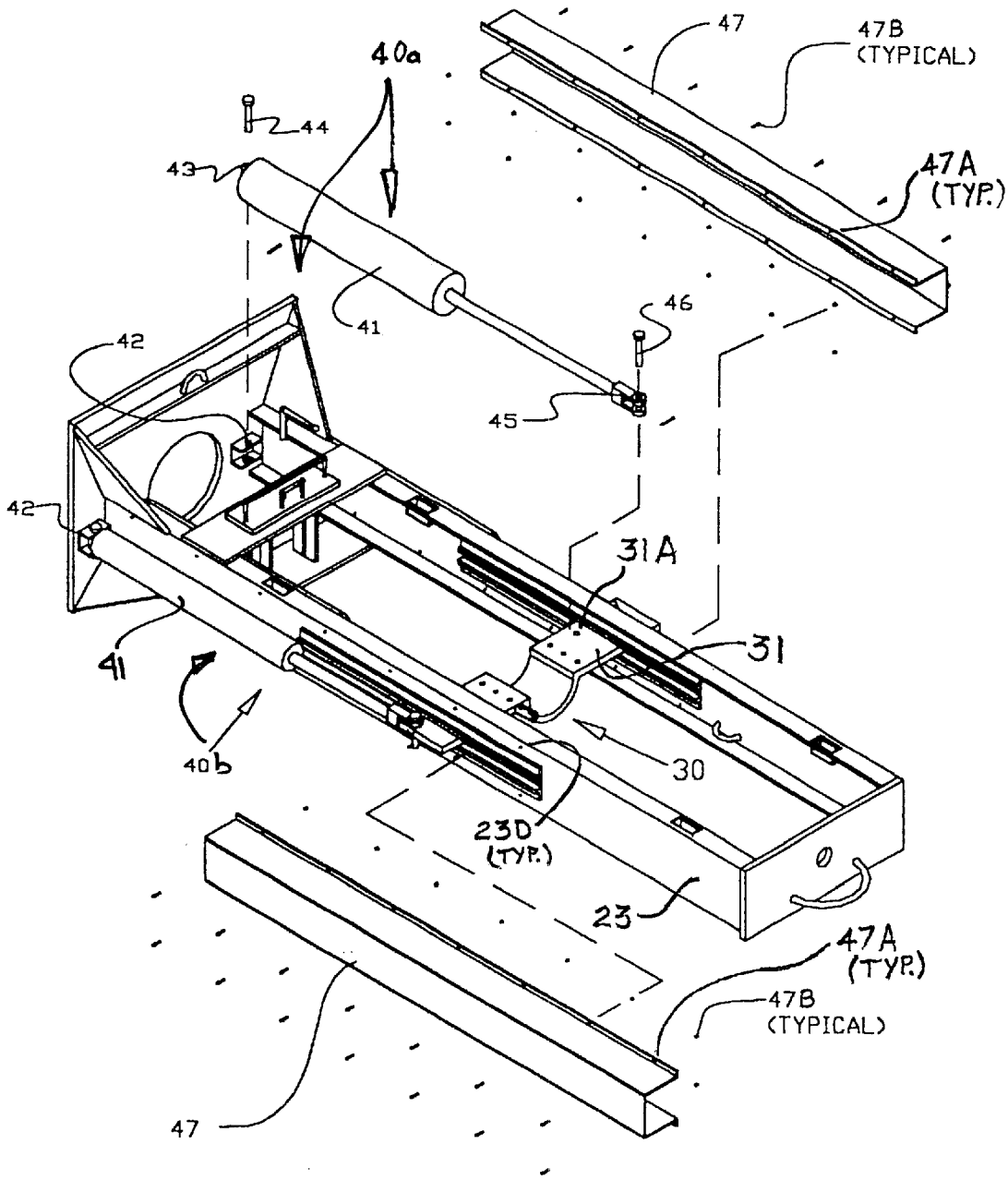
FIG. 3B is a partial exploded perspective view of the present invention, showing a typical hydraulic thrust cylinder assembly.
Figure 3C:
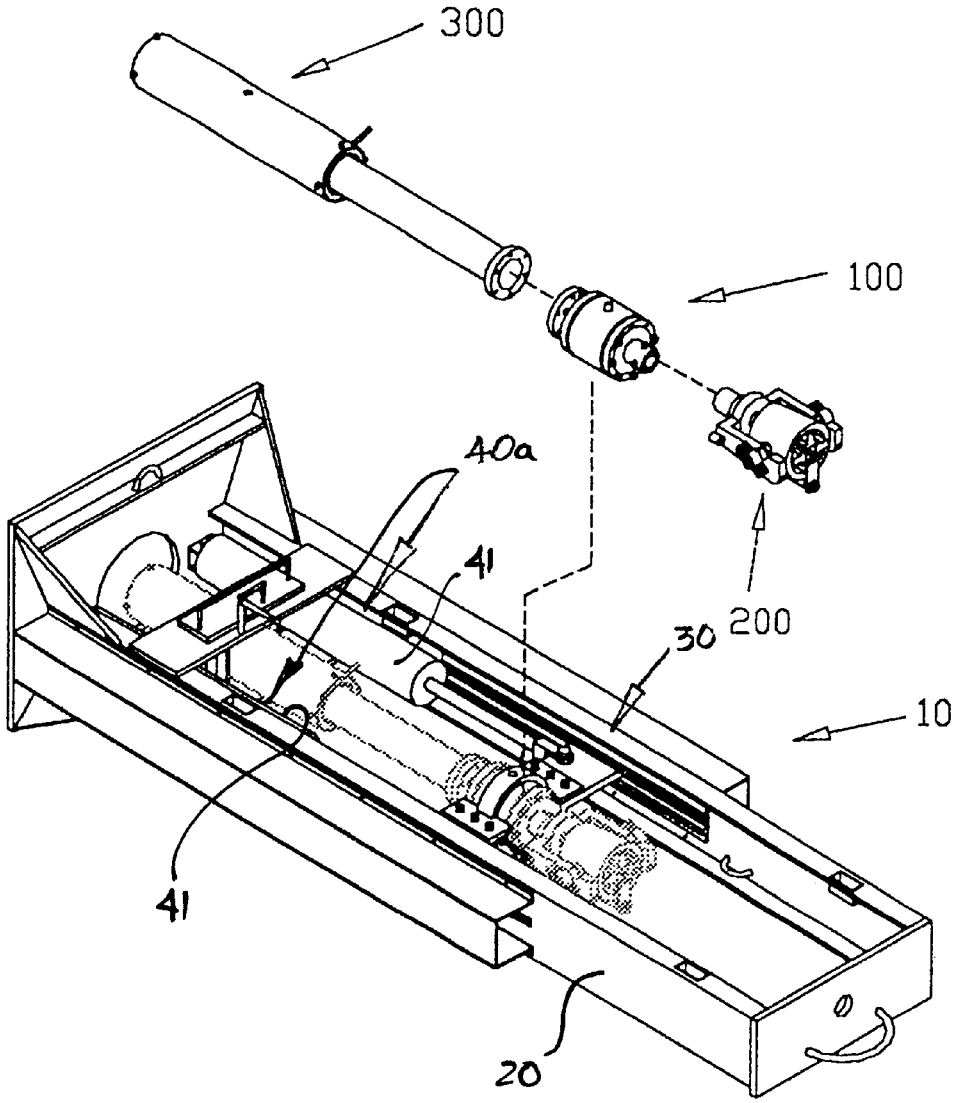
FIG. 3C is a partial exploded perspective view of the present invention, showing the inter-connection of the major component assemblies; support frame with sliding carriage, hydraulic cylinders, rotator, swivel, and reversible slip.

Referring to FIG. 3C, the rotating push rod boring rig 10 is an assembly comprising: a support frame 20, a reciprocating and sliding carriage 30, and hydraulic cylinders 41. As shown in shaded lines in frame 20 and shown in exploded view above the frame, the rig 10 further comprises a swivel 100, a reversible slip assembly 200, and a rotator 300.

Basically, and having reference to FIG. 1B, the hydraulic cylinders 41 reciprocate or stroke the slip assembly 200 forwards and rearwardly relative to the support frame 20.

In push mode, the stroked slip assembly 200 grips a push rod 11 and drives the drill string 12 on the forward stroke. On the return rearward stroke, the slip assembly 200 releases the rods 11 so that it can cycle rearwardly to commence a new stroke. During pushing, the reaction forces from the hydraulic cylinders 41 flow into the support frame 20 which in turn braces against the wall of the launching pit. The sliding carriage 30 guides the swivel 100 and slip assembly 200 during the stroke. During the push stoke, the rotator 300 causes the slip assembly 200 to be forcibly rotated and thus also cause the push rods 11 to rotate as they are pushed into the ground.

The slip assembly 200 is reversible so as to convert from a drill string pushing mode to a pulling mode.

In pull mode, the stroked slip assembly 200 grips and pulls the push rods 11 from ground on the rearward stroke. On the returning forward stroke, the slip assembly 200 releases the rods 11 so that it can cycle forwards to commence a new stroke. During pulling, the reaction forces from th hydraulic cylinders 41 are conducted into the support frame 20 which again braces against the launching pits wall, only on the opposing side. Typically during pulling the rotator 300 is disabled and the push rods 11 are no longer required to rotate as they are pulled from the ground.

The components are described in greater detailed as follows.

Support Frame and Sliding Carriage

As shown in FIG. 3A, the support frame 20 comprises a front bearing plate 21 (for pulling operations), reinforcement plates 22, left and right opposed U-channel side rails 23 with matching longitudinal centerline slots 23A located in web of rails 23, and a rear bearing plate 25 (for pushing operations). Mirrored pairs of slot reinforcement angles 27 are secured with bolts/nuts 27B through holes 27A and holes 23C along inner and outer longitudinal edges of slot 23A of rails 23.

Upper and lower cross brace plates 24 connect upper and lower flanges of side rails 23. Removal vertical brace 26 comprises a plate 26B, U-ring handles 26D, and two T-oriented back-to-back angle legs 26C. T-shaped legs 26C are received in corresponding T-shaped slots 24B of cross brace plates 24. Hole 24A in upper plate 26B of vertical brace 26 receives rotator-brace plate locking L-pin 26A.

Enlarged opening 21A on front plate 21 allows various tools larger in diameter than push rods 11, to pass-through (such as boring head 13 or enlarged pull-back boring heads, electronic transmitters, sondes or similar devices). Opening 25A on rear plate 25 is of sufficient size to permit the pass-through of a push rod 11.

Sliding carriage 30 comprises a swivel carrier 31, swivel clamp 102, and swivel interlock pin carrier 34. Clamp 102 is secured to carrier 31 by bolts/nuts 103 through holes 102C and holes 31B.

Assembled carriage 30 is interposed between side rails 23 of support frame 20. Guide slot plates 32 of carrier 31 are received in longitudinal slots 23A of side rails 23, further surrounded by pairs of reinforcement angles 27. This interfit allows the sliding carriage 30 to reciprocate forward and backward without a vertical movement component, within slots 23A of support frame 20 during the operation of boring system 10.

Hand tool holder slots 23B are provided at several locations in upper flange of rails 23 for conveniently storing pipe wrenches and other tools. Attached to rear, front, and sides of support frame 20 are C-ring lift points 25B, 28, 28A.

Hydraulic Cylinders

Having reference to FIG. 3B, inner and outer corresponding pairs 40*a*,40*b* of hydraulic cylinders 41 (four cylinders in total) are mounted on the inner face of front bearing plate 21 with one inner pair 40*a* inside the side rails 23 and one outer pair 40*b* outside side rails 23 of support frame 20. Conveniently, double-acting cylinders are provided to minimize the number of cylinders used to provide both carriage push and pull. Each cylinder 41 has a piston and a piston rod. The retracting stroke loses some fluid area due to the piston rod. Accordingly, in the disclosed orientation, during an extension and rod pulling stroke, the full hydraulic fluid area of the piston is available for meeting these high load pulling operations.

A typical hydraulic cylinder 41 (one of a matched inner pair 40*a* or outer pair 40*b*) comprises a hydraulic double-acting thrust cylinder with a base bracket 43 and pin 44 attached to base bracket support 42 mounted to the inner face of front bearing plate 21. Front bracket 45 and pin 46 attaches to carrier 31 through holes 31A.

Outer hydraulic cylinder pair 40*b* and slots 23A are safely protected under protection covers 47 attached by bolts/nuts 47B through holes 47A and 23D.

In the preferred embodiment as shown in FIG. 3B, inner pair 40*a* of hydraulic cylinders 41 are of larger capacity and size than outer pair 40*b* of hydraulic cylinders 41.

Appropriate hydraulic fluid lines, valves, and controls as they are well known, are not indicated on the drawings.

Alternative embodiments may include a single pair 40*a* or 40*b* only or additional pairs of matched hydraulic cylinders mounted on inner face of front bearing plate 21 located either inside or outside of side rails 23, a pair or multiple pairs of matched hydraulic cylinders 41 mounted on inner face of an enlarged rear bearing plate 25 with additional reinforcement plates 22, or the combination of a pair or multiple pairs of matched hydraulic cylinders 41 mounted on both front 21 and rear 25 bearing plates with appropriate reinforcement plates 22.

Of course, further alternative embodiments may also include various combinations of more powerful or less powerful sized matched pairs of hydraulic thrust cylinders.

Swivel

Figure 6:
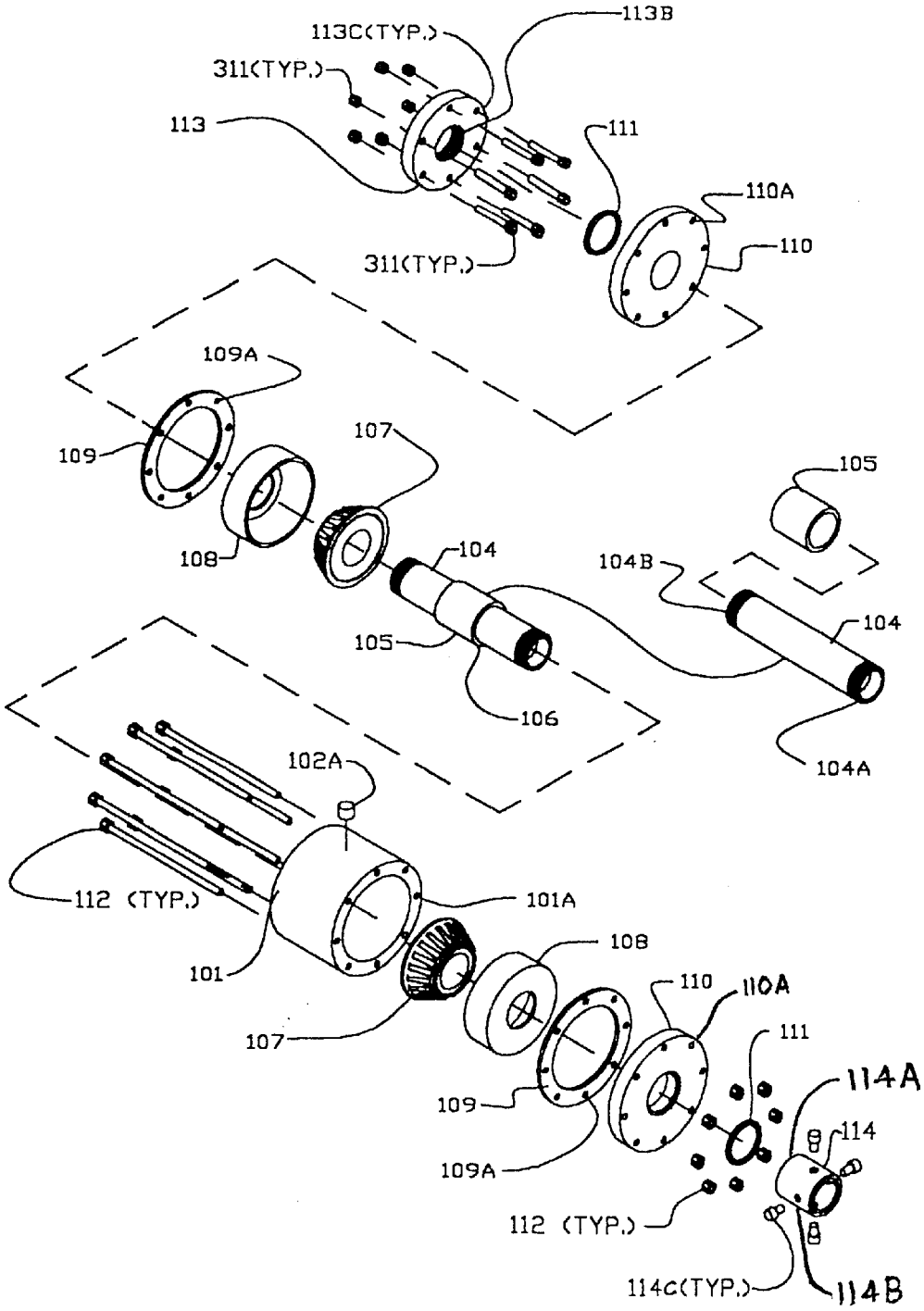
FIG. 6 is an exploded perspective view of the complete swivel assembly referred to in FIG. 3C.

Having reference to FIGS. 6, 6A, 6B, the swivel assembly 100 supports and guides the rotating slip assembly 200 and push rods along the non-rotating support frame 20.

Swivel 100 has cylindrical bearing case 101 for rotationally supporting a cylindrical thrust sleeve. The thrust sleeve 105 is placed over, centered, and secured to a hollow bearing shaft 104 having an inside diameter of sufficient size to permit the push rod 11 to pass therethrough.

Over each end of bearing shaft 104 are located opposed and tapered roller bearings 107 with bearing cups 108 are slid axially inward towards each other until they bear against shoulders 106 of thrust sleeve 105.

Shims 109, and end flanges 110 with lip seals 111 are slid axially inward from either end of shaft 104 with their respective bolt holes 109A and 110A aligned with bolt holes 101A of case 101 and fastened together with through bolts/nuts 112 to close case 101.

An alignment pin 102A positioned at 12:00 o'clock on the cases 101 for maintaining pinned alignment in plate 31.

The swivel 100 is connected to the rotator 300 and to the reversible slip assembly 200. A rotator connection flange 113, having a left hand thread 113B, is threaded to the left-hand threaded end 104B of shaft 104. Slip connector sleeve 114 with an internal right-hand thread 114A is threaded to right-hand threaded end 104A of shaft 104.

Assembled swivel 100 is placed in sliding carriage 30 and carrier 31 with rotator-swivel connection flange 113 facing the front of boring machine 10 and alignment pin 102A in the 12:00 o'clock position (see FIG. 3C). Clamp 102 is placed over swivel 100, with hole 102B of clamp 102 aligned with pin 102A of bearing case 101. Clamp 102 is then secured to carrier 31 with bolts/nuts 103.

Slip Assembly

Figure 4:
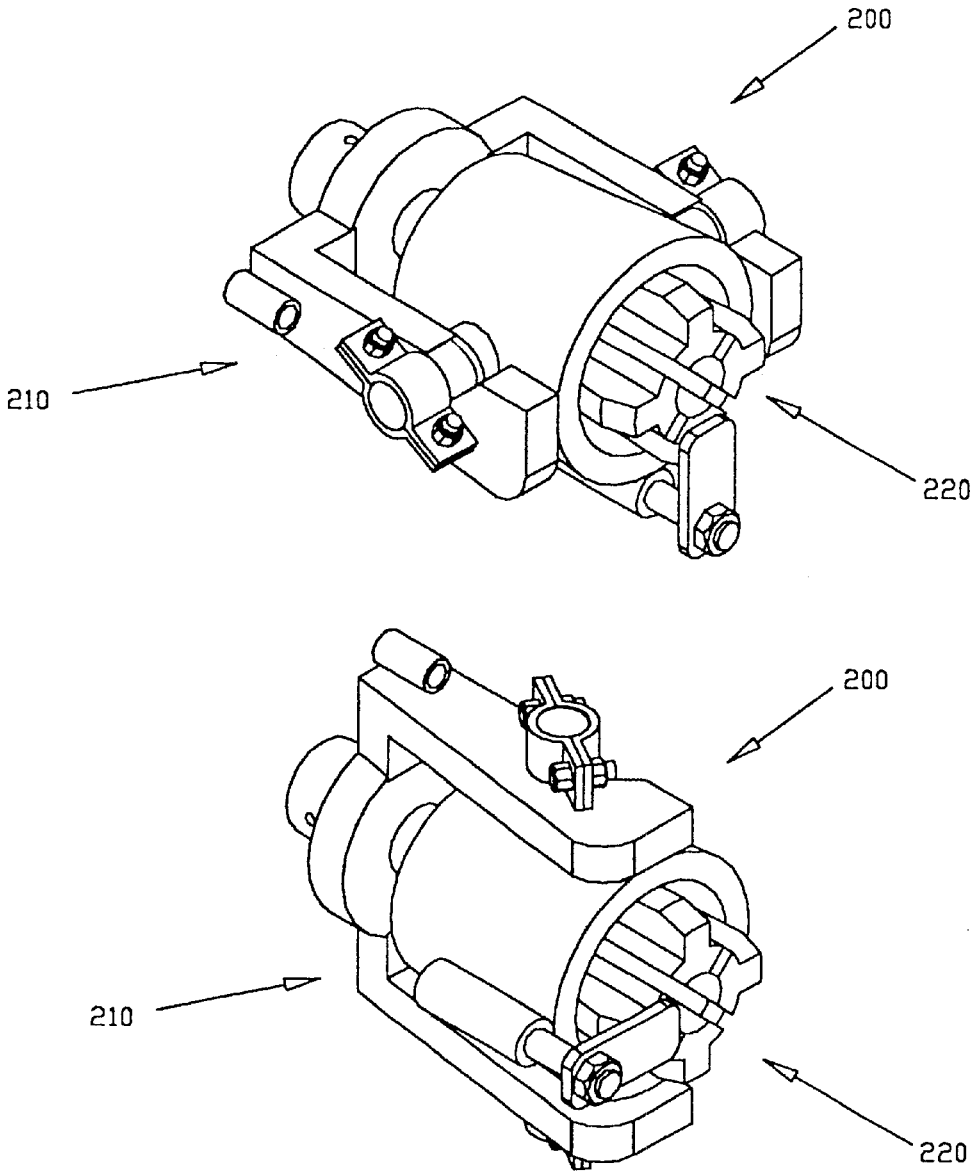
FIG. 4 shows a top and bottom perspective view of the reversible slip assembly, showing the reverse-pull gripping orientation referred to in FIG. 3C.
Figure 4A:
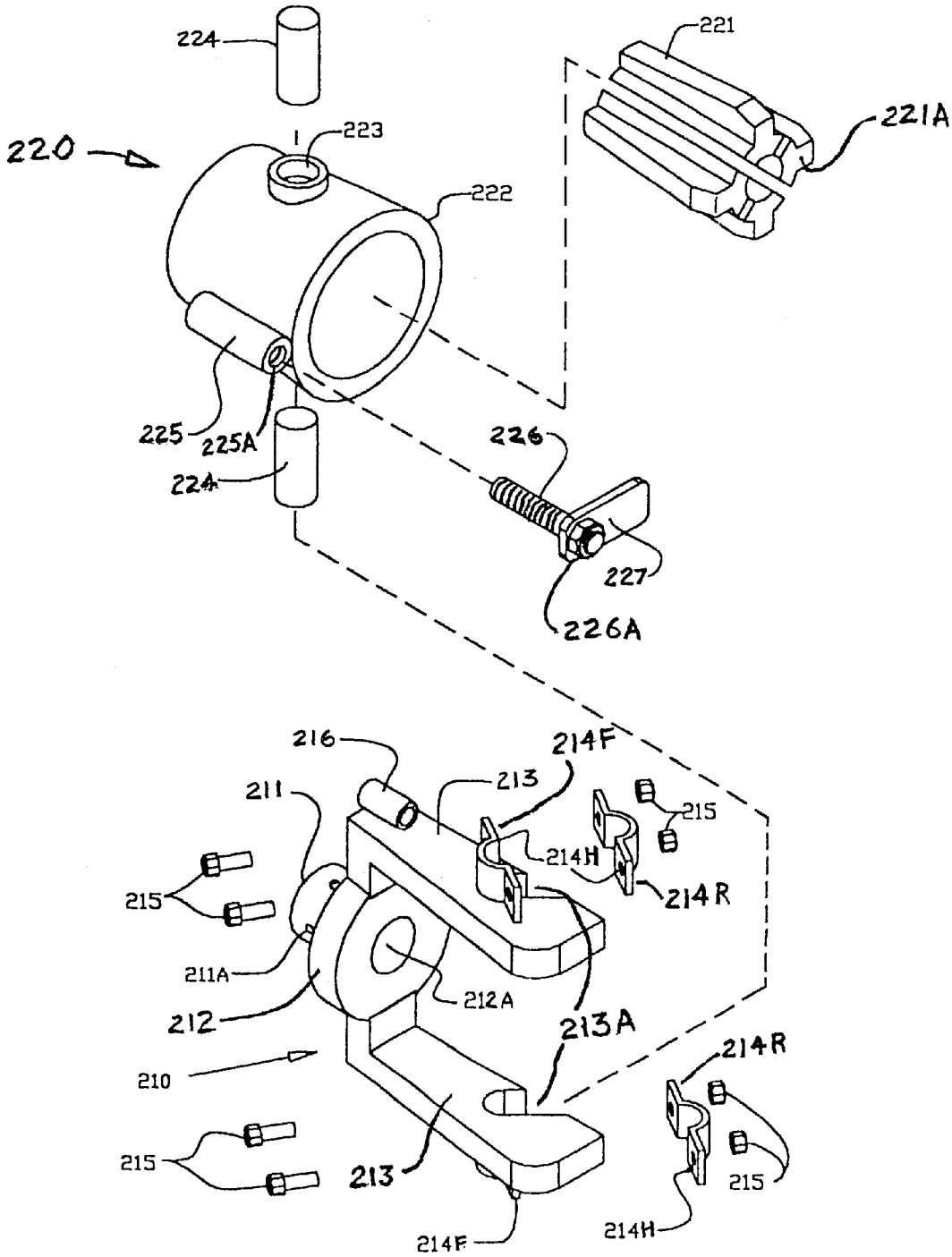
FIG. 4A is an exploded perspective view of the reversible slip assembly referred to in FIG. 4.

Reversible slip assembly 200 is described in FIGS. 4, 4A. The slip assembly is a unidirectional device is thus is capable only of gripping when moved in one direction. The slip assembly 200 permits the drill string 12 to be pushed, and when called for, can be pivotally reversed so as to enable pulling of the same push rods.

Figure 7:
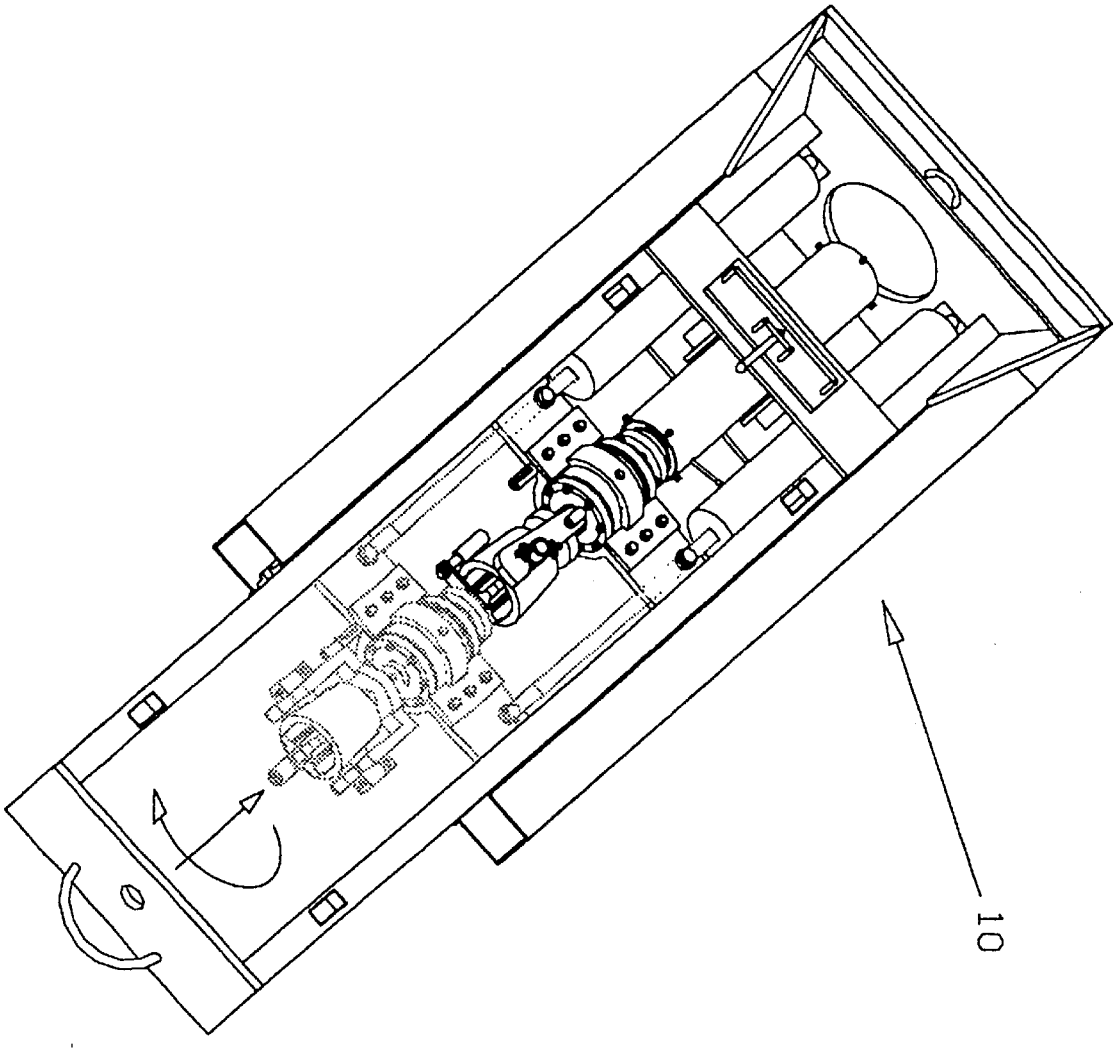
FIG. 7 is a perspective top view of the rotating push rod boring system according to the preferred form of the invention, showing the relative motion of the components for one pull-push cycle of combined axial and rotational movement.

Slip assembly 200 comprises two subassemblies, a slip support or yoke 210, and a reversible gripper 220. As shown in FIG. 7, yoke 210 comprises a swivel hub 211 is centrally attached to one face of a circular flange 212 with a bore 212A passing therethrough, the bore having an inside diameter of sufficient size to permit the pass-through of push rod 11.

Two arms 213 are attached to the perimeter of flange 212 at the 9:00 o'clock and 3:00 o'clock positions (see FIG. 6B). Axle pin sockets 213A are provided at the distal end of the arms 213. Fixed axle clamps 214F are attached to outside face of arm 213 for closing sockets 213A.

Reversible gripper 220 comprises a tapered slip bowl 222, slips 221 suitable for gripping the diameter of push rods 11 and axles 224 for assembly in the yoke's complementary sockets 213A. Slips 221 may be gated or ungated, depending on manufacturer and model used. In the preferred embodiment, suitable slips 221 include a gated Guiberson™-MODEL NO. T-60 "Tubing Spider".

Diametrically opposing axles 224 are installed on either side of the slip bowl 222 at pin support rings 223. Slip retainer stud carrier 225 is fastened to bowl 222. Slip 221 is placed in bowl 222, and retainer 227 is secured into stud carrier 225 with retainer 227 extending over slip end 221A to prevent slip 221 from falling out of bowl 222.

The axles 224 are secured in sockets 213a with the removable axle clamps 214R and fixed axle clamps 214F and are secured with bolts/nuts 215 through holes 214H.

Having reference now to FIGS. 6A and 6B, to attach reversible slip assembly 200 to swivel 100, the yoke's hub 211 is placed within slip connector sleeve 114, and holes 211A and threaded holes 114B are aligned and secured with cap screws 114C.

Slip interlock pin carrier 216 is aligned with swivel interlock pin carrier 34, and interlock pin 34A is slid forward into slip pin carrier 216 with pin mover 34B following elongated portion of U-slot 34C and locked down into furthermost leg of U-slot 34C in swivel pin carrier 34.

To reverse gripping action of reversible slip assembly 200, gripper 220 is rotated end-for-end around axle pins 224. The larger diameter end of the tapered bowl 222 is rotated to face the direction the push rods are being forced. Accordingly, as reaction, when the push rods and slips resist the force, the tapered bowl directs the slips radially inward to tighten and grip on the push rods. In the case of pushing the drill string, the bowl's larger end faces the target pit TP. To pull the push rods, the bowl is reversed with the bowl's large end facing away from the target pit TP.

Rotator

Figure 5:
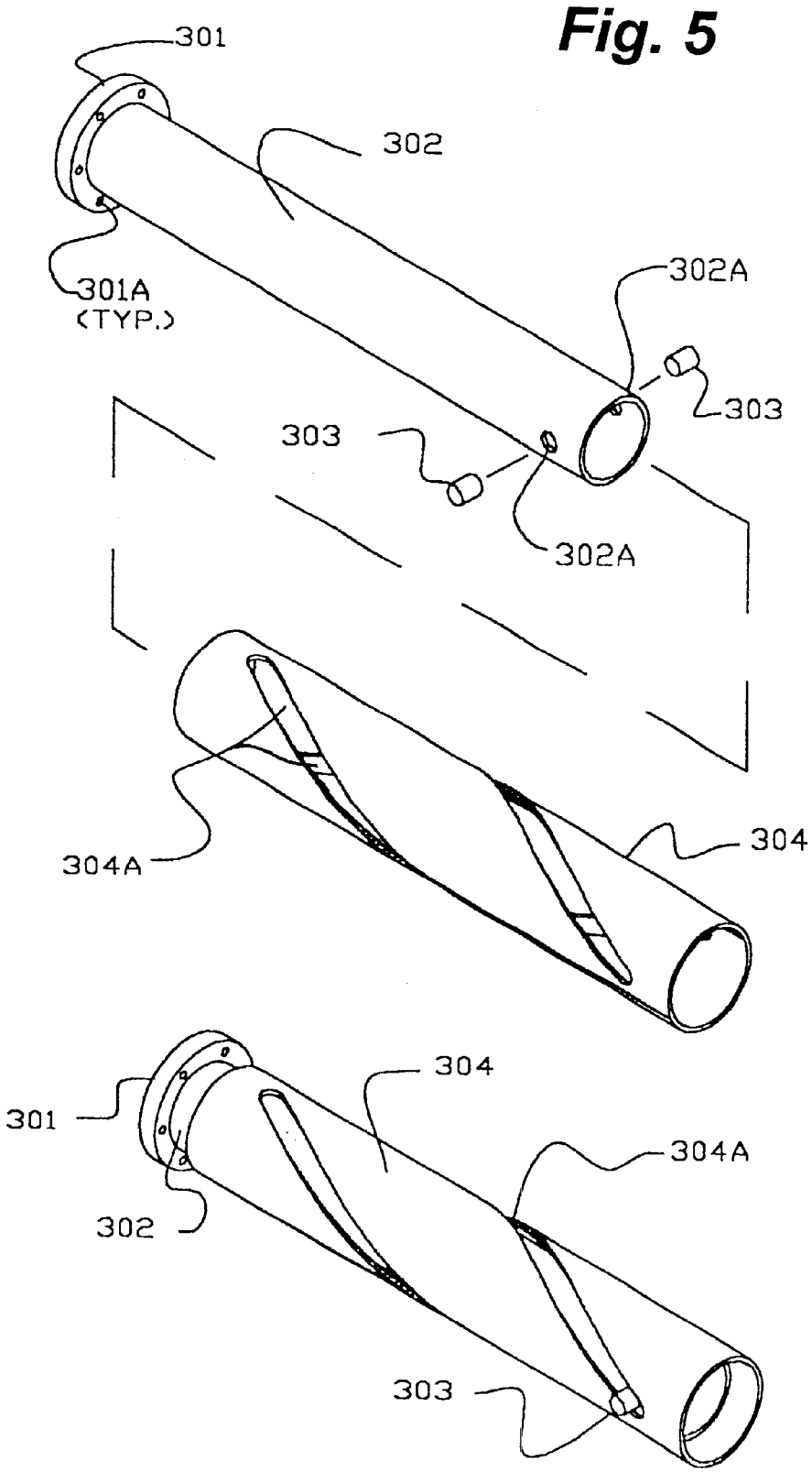
FIG. 5 is an exploded perspective view of the inner components of the rotator assembly referred to in FIG. 3C.
Figure 5A:
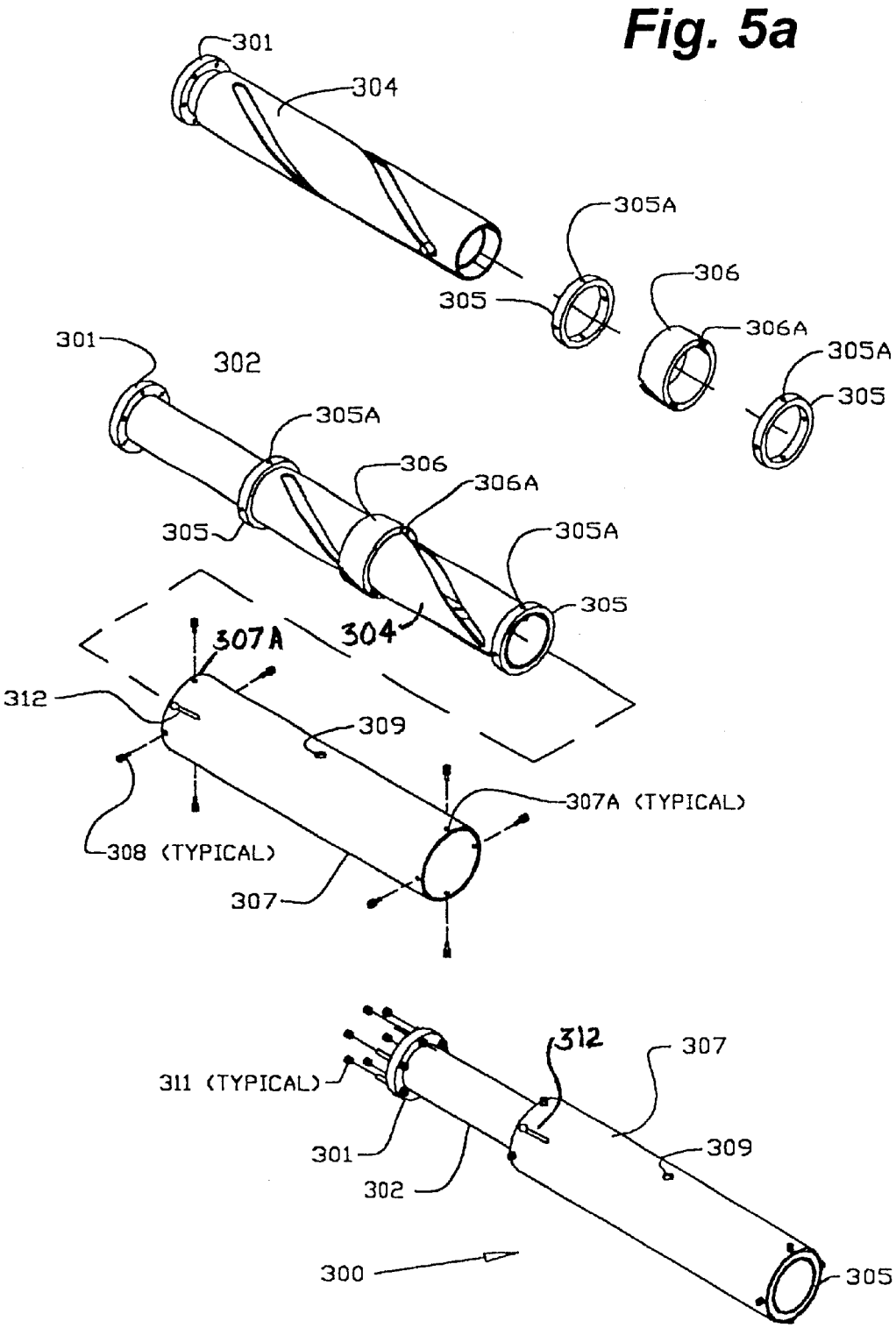
FIG. 5A is an exploded perspective view of the outer components of the rotator assembly and the perspective view of the complete assembled rotator assembly referred to in FIG. 3C.

Having reference to FIGS. 5, 5A, the rotator 300 comprises an inner member or conduit 302 having an inside axis which is open and of sufficient diameter to permit pass-through of push rod 11.

A swivel connection flange 301 is secured to one end of inner conduit 302. At the distal or opposite end of conduit 302 are two diametrically opposed guide pins 303 installed into holes 302A. Torsion applied to the inner conduit 302, through pins 303, is transmitted through the inner conduit 203 to the swivel 100 through connection flange 301.

A middle conduit 304 has an inside diameter sufficient to permit concentric installation of inner conduit 302. The wall of middle conduit 304 is formed with two helical matched or opposing slots 304A of a width slightly larger than outside diameter of pins 303. Opposing slots 304A helically spiral 270 degrees down the length of the middle conduit 304 (¾ turn). To maintain integrity of the conduit 304, a short length of unslotted conduit remains at either end.

Middle conduit 304 is slid over the inner conduit 302 and slots 304A are aligned with holes 302A. The solid pins 303 are placed through slots 304A and are secured to inner conduit 302. Middle conduit 304 is normally non-rotating and thus, any axial movement of inner conduit 302 relative to middle conduit 304 results in a corresponding rotation of the inner conduit 302. Rotation of the inner conduit 302 causes rotation of swivel 100, slips 221 and any push rods 11 gripped therein.

Annular spacing rings 305 are positioned over either end of middle tube 304. A sectional center reinforcement ring 306 is formed with corresponding with slots 306A. Ring 306 is centered and fastened on tube 304 with slots 306A aligned with slots 304A. At either end of tube 304, spacing rings 305 are positioned and secured, so that threaded holes 305A of each ring 305 are aligned.

A final outer conduit or tube 307 is positioned concentrically over rings 305 and 306, and is secured with fasteners 308 through holes 307A into threaded holes 305A of rings 305. The outer conduit is a safety device which protects personnel from the slot and pin portion.

Rotator 300 is attached to swivel 100 using bolts/nuts 311 through holes 301A in flange 301 and holes 113C in flange 113. Rotator 300 is adjusted with handle 312 until hole 24A of upper cross brace 24 and hole 309 of outer tube 307 align at 12:00 o'clock position (see FIG. 3C). Removable L-pin 26A is inserted through hole 24A and hole 309 so as to prevent the outer tube 307 from any further rotation, readying boring system 10 for combined axial and rotation movement.

Operation

While the operation of this embodiment of the rotating push rod boring system should be apparent from the foregoing description of its construction and assembly, a further description of operation will be given to facilitate a more thorough understanding of the invention.

It should be noted that the preferred embodiment of the invention has been shown as operating from launching pit LP and directed toward target pit TP. This embodiment will function in the same manner, originating at the surface, for boring an inclined starting hole by merely bracing and supporting the rear 25 of the boring system 10 at the appropriate angle of entry of the boring head 13 into the earth. Also, in lieu of target pit TP, a surface location may also be the objective of a boring operation.

Referring to FIGS. 1 and 2, boring rig 10 is situated in launching pit LP having rear plate 25 against rear pit wall with front bearing plate 21 oriented to face in general direction of target pit TP or surface target.

Slip assembly gripper 220 is readied for forward pushing movement of the drill string 12. Gripping for this forward, pushing movement of push rod 11 is accomplished with larger diameter end of tapered bowl 222 of gripper 220 facing front of boring rig 10. Slips 221 grip push rods 11 on the push portion and release the rods 11 on the retract portion of one push-retract cycle of the hydraulic cylinders 41. The use of taper bowl slips 221 provides higher load capacity, automatic gripping and release, uniform circular gripping with even load distribution, and automatic alignment of push rods 11. These improvements alleviate the problems found in known grippers of existing push rod boring systems.

As stated above, one or both pairs of hydraulic cylinders 41 are connected to sliding carriage 30 with pins 46, depending on the type of soil in which the borehole will be formed, the length and diameter of borehole, conditions at the job site, or other factors.

The push rods 11 are connected together with their threaded corresponding male and female joints end-to-end and are fed forward through gripper 220, through swivel 100, and through rotator 300 until a leading female thread of a first push rod 11 is accessible. Boring head 13 with electronic transmitter, sonde or similar device is then threaded onto leading end of drill string 12.

The use of electronic transmitters, sondes, or similar devices used to monitor the progress of the boring head 13, determine the need for path corrections or changes of boring head 13, indicate the orientation of the bevel face 13A on boring head 13 are well known, and are not discussed in depth.

To ready the boring rig 10 for combined axial and rotation movement, the rotator's outer tube 307 is adjusted with handle 312 until hole 24A of upper cross brace plate 24 is aligned with hole 309 of outer tube 307. L-pin 26A is inserted through aligned holes 24A and hole 309, retaining or locking the rotator 300 both axially and rotationally to the upper cross brace 24. Outer tube 307 of rotator 300 is prevented from any further rotation as in the middle tube with the spiral slots. The outer tube 307 is further prevented from any vertical or lateral movement by the surrounding box opening provided by double T-slot connection between upper and lower cross braces 24, and vertical brace 26. The upper plate 24 and vertical brace 26 are removable for enabling better access to the rig 10.

Referring now to FIGS. 1, 3C and 7, simultaneous axial and rotational movement of the push rods 11 is achieved due to the combination and relationship of the described components including: the non-rotating support frame 20, sliding carriage 30, hydraulic cylinders 41, swivel 100, slip assembly 200, and rotator 300.

As hydraulic cylinders 41 cycle (a cylinder 41 retracts to push the drill string 12) using hydraulic controls (not shown), the sliding carriage 30, swivel 100, slip assembly 200, and inner rotator tube 302 reciprocate forward and rearward within slots 23A of side rails 23. As push rods 11 are progressively threaded onto end of drill string 12, the entire drill string 12 is axially advanced by the repeated grip and subsequent release of the slips 221 on the push rods 11.

As drill string 12 moves forward (the retract portion of the hydraulic cylinder stroke), slip 221 grips push rod 11. Simultaneous rotational movement is created as pins 303 of moving inner conduit 302, are caused to helically spiral clockwise ¾ of a turn to follow helical slots 304A. Interconnected components of the inner conduit 302 and slip assembly 200 move forward with simultaneous axial and rotational movement, rotating in the carrier 30 through swivel 100.

During the retracting movement (extension portion of the hydraulic cylinder stroke) of hydraulic cylinders 41, s lips 221 releases their grip on the drill string 12, and fixed pins 303 reverse spiral counter-clockwise the ¾ turn, resetting for the next cycle.

Illustrative of the operation of the preferred embodiment, a four-foot long push rod is pushed forward its entire length while being rotated 1½ turns in two complete cycles or strokes of the boring rig 10. This is in contrast to the known push rod boring systems of Malzahn '999 and '948 which can only rotate the push rod only 320 degrees in five and one third complete strokes. For a straight-line borehole of a length of one hundred feet, the preferred embodiment of the present invention requires 50 complete hydraulic cylinder strokes resulting in 37½ turns of the drill string. The Malzahn '999 and '698 systems require 133⅓ strokes to achieve only 22¼ drill string rotations.

When directional corrections are required, the boring system 10 is cycled with drill string 12 rotating until bevel face 13A of boring head 13 reaches desired orientation. Forward pressure is relaxed on drill string 12 by slight rearward movement of hydraulic cylinders 41. Rotational movement of drill string 12 is discontinued by removal of L-pin 26A from hole 309 in outer tube 307, releasing the locked connection between support frame 20 and the helical slots 304A of the rotator's middle tube 304.

Alternatively, rather than using the rig 10 to orient the boring head, a pipe wrench can be is placed on a push rod 11 to rotate drill string 12 clockwise until desired orientation of bevel face 13A of boring head 13 is reached.

Now, retraction of hydraulic cylinders 41 causes the slip 221 to grip push rod 11 and axially advance drill string 12 without rotation. Interconnected components of slip assembly 200, swivel 100, and rotator 300 move forward without rotation. Inner conduit 302 and pins 303 also move forward. The unrestrained outer tube 307 and middle conduit 304 also move forward and thus pins 303 are not caused to rotate.

As drill string 12 is pushed through the soil without rotation, it takes a corrective course. This push-retracting cycle continues until steering correction or curve of drill string 12 is achieved.

When directional control is again desired, grip of the drill string 12 is released and L-pin 26A is reinserted into hole 309 of outer tube 307, again readying boring rig 10 for straight line boring using the combined axial and rotation movement.

Once target pit TP or surface target has been reached, the operator proceeds with pullback portion of boring operation. The gripper is reversed so that the slips 221 are properly oriented for pulling the drill string 12. Note that a length of push rod 11 is extending through the slips, blocking its rotation.

To enable reversing of the slips 221, the drill string 12 is advanced until that last connected joint of drill string 12 moves forward past the front end of reversible gripper 220. Then this last length of push rod 11 extending through the slip assembly 200 can be removed. A pipe wrench is placed on last connected push rod 11 for counter clockwise turning, while another pipe wrench is placed on one of the next accessible, forwardly located push rod 11 of drill string 12 for clockwise turning.

Counter-turning of opposing pipe wrenches breaks the last joint of drill string 12. This last push rod 11 is unthreaded and pulled back out of gripper 220. The freed gripper 220 is rotated end-for-end around axle pins 224 reversing its grip. Now pull movement of push rod 11 is accomplished as the larger diameter end of bowl 222 of gripper 220 faces the rear of boring rig 10.

A length of push rod 11 is passed again through gripper 220, and rethreaded onto end of drill string 12. Accordingly, the gripper slips 221 can now pull on the drill string 12.

A borehole enlarger or utility lines are attached to leading end of drill string 12. Rotational movement of drill string 12 is discontinued by removal of L-pin 26A out of hole 309 in outer tube 307, enabling the outer tube 307 and middle tube 304 to move on each stroke.

If required, a second pair 40*b* of hydraulic cylinders 41 is connected to sliding carriage 30 with pins 46. Conveniently, hydraulic cylinders 41 can be cycled a few times to pull the boring rig's support frame 20 across the pit until front bearing plate 21 reaches front wall of launching pit LP while keeping enlarged opening 21A of front bearing plate 21 centered around borehole. Alternatively, front bracing (wood timbers, etc.) is disposed in front of front bearing plate 21.

Accordingly, the boring rig 10 is prepared for pulling of the drill string 12 and attached apparatus.

The powerful rearward extension stroke of the hydraulic cylinders 41 causes slip 221 to grip push rod 11 and axially retract drill string 12 without rotation. Interconnected components of slip assembly 200, swivel 100, and rotator 300 also move backward without rotation.

Retraction of the hydraulic cylinders 41 releases grip of slip 221 on push rod 11, and interconnected rotator 300, swivel 100, and slip assembly 200 move forward without rotation.

This pull-retraction cycle of the hydraulic cylinders 41 is repeated until the enlarger and/or utility lines reach the starting point of the borehole.

As each last connected push rod 11 is moved rearward, and clears the rear end of gripper 220, pipe wrenches are attached to rearmost push rod 11 and next accessible forward pushrod 11 and the end push rod 11 is unthreaded for removal from drill string 12.

The present invention provides advantages both in performance and longevity of the components. For example:

- the long stroke results in a reduced number of cycles results in a significant decrease in drilling time and decreased wear-and-tear on component parts;
- increased drill string rotations to stoke ratio and continual rotation results in very tight symmetrical helical spiraling of the boring head, creating substantially straight boreholes;
- increased drill string rotation combined with positive and continual rotation improves boring head tracking and precise orientation;

the tightly helical borehole requires fewer course corrections, reduces the incidence of binding, rod bending and thread damage to push rod joints, all of which further contribute to reducing drilling time;

the pull-back capacity of the rig is increased over known through the use of a plurality of hydraulic cylinders, due to the use of the maximal power extension stroke, and further by providing an option of coupling an auxiliary pair of hydraulic cylinders to drive the carrier; and the slip-type gripper avoids damage to push rods for reduced life and secure use, and the ability to vary push rod diameter without an equipment change.

While this invention has been described fully and completely with special emphasis upon the preferred embodiment of the invention it should be understood that within the scope of the appended claims the invention may be practiced otherwise than as specifically described above.

The embodiments of the invention for which an exclusive property or privilege is claims are defined as follows:

1. A rotator for a push rod apparatus having a carriage which is stroked forwards and rearwards for cyclically moving a plurality of push rods into the ground in front of the carriage and along an axis, the rotator comprising:

(a) a swivel supported by the carriage and having a rotating sleeve and an axis sized to freely pass the push rods;

(b) unidirectional gripping means for alternately gripping and releasing the rod as the carriage stokes and which is supported axially in-line with and rotationally from the sleeve so that as the carriage reciprocates the gripping means cycles the push rods unidirectionally;

(c) a torsion member which is supported by and rotatable with the sleeve, the torsion member having an axis for freely passing the push rods and having two or more pins extending perpendicularly therefrom;

(d) a tubular conduit located and extending concentrically about the torsion member, the conduit having or more helical slots which correspond in number to and guide the torsion member's pins; and (e) means for restraining axial and rotational movement of the conduit when the carriage is reciprocated so that the torsion member is urged to rotate in order for its pins to follow the slots and thereby also cause the sleeve, gripping means and rods to rotate.

2. The rotator of claim 1 wherein:

(a) the gripping means is positioned rearwards of the swivel; and (b) the torsion member is positioned forwards of the swivel.

3. The rotator of claim 2 further comprising a yoke which is supported by, rotatable with, and extends rearwardly of the sleeve, the yoke supporting the gripping means, the gripping means being reversible in the yoke between a push mode and a pull mode so that:

(a) in the push mode, a forward stroke grips and pushes the rods forward into the ground and on a rearward stroke releases the rod; and (b) in the pull mode, a rearward stroke grips and pulls the rods rearward from the ground and on a forward stroke releases the rod.

4. The rotator of claim 3 wherein the gripping means is a slip assembly having a bore aligned with the push rods.

5. The rotator of claim 4 wherein the slip assembly further comprises tapers slips in a bowl, the bowl being reversible in the yoke.

6. The rotator of claim 3 wherein the tubular conduit restraining means is alternately lockable and releasable so that:

(a) when locked, the conduit is restrained and reciprocating movement of the carriage causes the torsion member and push rods to rotate while the push rods advance; and (b) when released, the conduit is free to reciprocate with reciprocating movement of the carriage and the push rods to merely advance without rotating.

7. The rotator of claim 1 wherein the helical slots spiral greater than 90 degrees over the length of the conduit.

8. The rotator of claim 1 wherein the helical slots spiral for about 270 degrees over the length of the conduit so that the push rods are rotated about 270 degrees during a stroke of the carriage.

9. Push rod boring apparatus using the rotator according to claim 1 further comprising:

(a) a non-rotating frame having a front ground-facing end and a rear end; and (b) actuating means acting between the frame and the carriage for reciprocating the carriage.

10. The push rod boring apparatus of claim 5 wherein the actuating means are one or more hydraulic cylinders.

11. The push rod boring apparatus of claim 10 wherein the hydraulic cylinder or cylinders are double-acting cylinders each of which have a piston and a piston rod and actuate with an extension stroke and a retracting stroke, at least one of the cylinders being arranged to pull push rods on its extension stroke.

* * * * *